US006837780B1

(12) United States Patent
Broido

(10) Patent No.: US 6,837,780 B1
(45) Date of Patent: Jan. 4, 2005

(54) LAPPING AND POLISHING DEVICE

(75) Inventor: Georges Henri Guy Broido, Collonges-sous-Saleve (FR)

(73) Assignee: Lam-Plan S.A., Gaillard (FR)

( * ) Notice: Subject to any disclaimer, the term of this patent is extended or adjusted under 35 U.S.C. 154(b) by 0 days.

(21) Appl. No.: 09/831,865

(22) PCT Filed: Nov. 17, 1999

(86) PCT No.: PCT/FR99/02817

§ 371 (c)(1),
(2), (4) Date: Sep. 29, 2001

(87) PCT Pub. No.: WO00/30806

PCT Pub. Date: Jun. 2, 2000

(30) Foreign Application Priority Data

Nov. 19, 1998 (FR) ..... 98 14563

(51) Int. Cl.[7] ..... B24B 7/00

(52) U.S. Cl. ..... 451/527; 451/528; 451/530; 451/533; 451/287

(58) Field of Search ..... 451/28, 41, 285, 451/287, 288, 527, 530, 533, 528

(56) References Cited

U.S. PATENT DOCUMENTS

| | | | | |
|---|---|---|---|---|
| 4,866,886 A | | 9/1989 | Holmstrand | |
| 5,022,191 A | | 6/1991 | Broido | |
| 5,297,364 A | | 3/1994 | Tuttle | |
| 5,441,598 A | * | 8/1995 | Yu et al. | 51/209 |
| 5,882,251 A | * | 3/1999 | Berman et al. | 451/527 |
| 6,110,015 A | * | 8/2000 | Christianson et al. | 451/41 |
| 6,238,273 B1 | * | 5/2001 | Southwick | 451/41 |
| 6,328,632 B1 | * | 12/2001 | Chopra | 451/41 |
| 6,439,986 B1 | * | 8/2002 | Myoung et al. | 451/443 |
| 6,488,575 B2 | * | 12/2002 | Agarwat et al. | 451/228 |
| 6,575,825 B2 | * | 6/2003 | Tolles et al. | 451/530 |

FOREIGN PATENT DOCUMENTS

| | | |
|---|---|---|
| EP | 0 370 843 D | 5/1990 |
| EP | 0 370 843 A | 5/1990 |
| FR | 97 03605 A | 10/1998 |
| GB | 2 043 501 X | 10/1980 |

* cited by examiner

*Primary Examiner*—Eileen P. Morgan
(74) *Attorney, Agent, or Firm*—Leydig, Voit & Mayer, Ltd.

(57) ABSTRACT

The invention concerns a polishing or lapping device comprising a surface whereon parts to be polished are to be applied, with an interposed abrasive suspension, and with a certain pressure. The invention is characterized in that said surface comprises a plurality of recessed parts (1, 16, 17) forming reservoirs for the abrasive suspension independent of one another and said recessed parts (1, 6, 17) are defined by partitions (2, 26, 27) whereof the top walls (20), co-operating with said abrasive suspension, form active zones for lapping or polishing, said partitions (2, 26, 27) having a substantially constant height over the whole surface of the device, before it is used. The invention is useful for polishing or lapping metal parts.

14 Claims, 4 Drawing Sheets

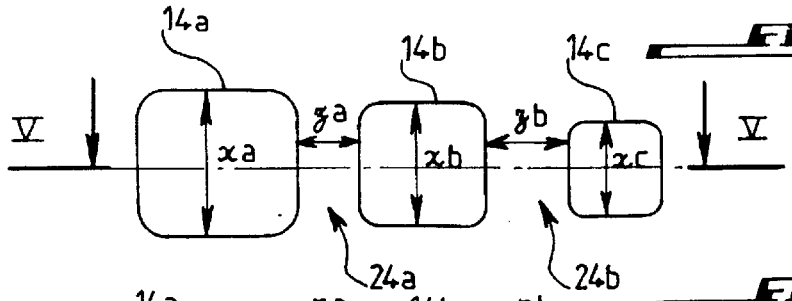
Fig. 4
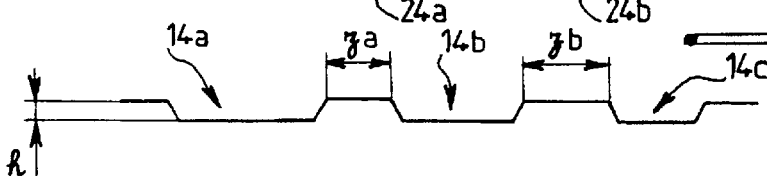
Fig. 5
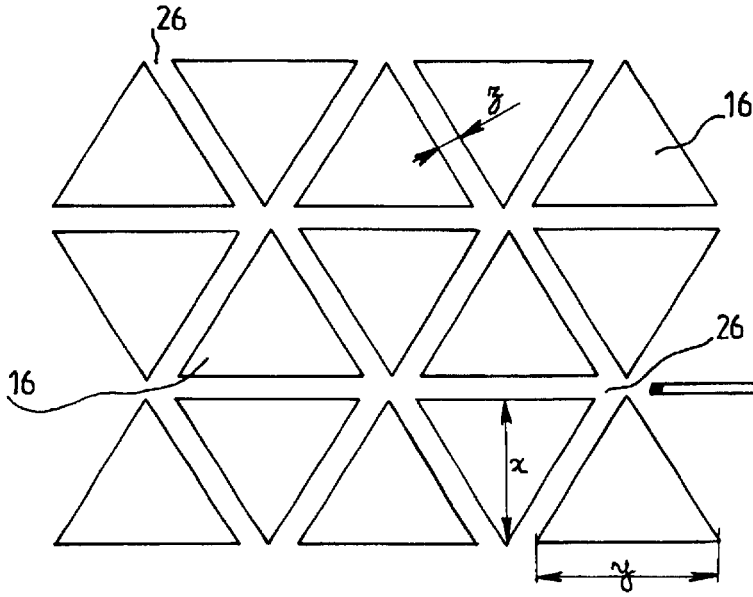
Fig. 6
Fig. 7
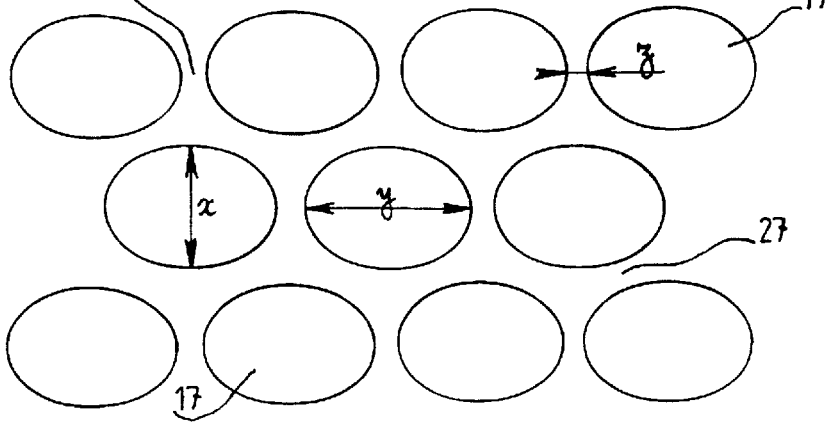

Fig. 8
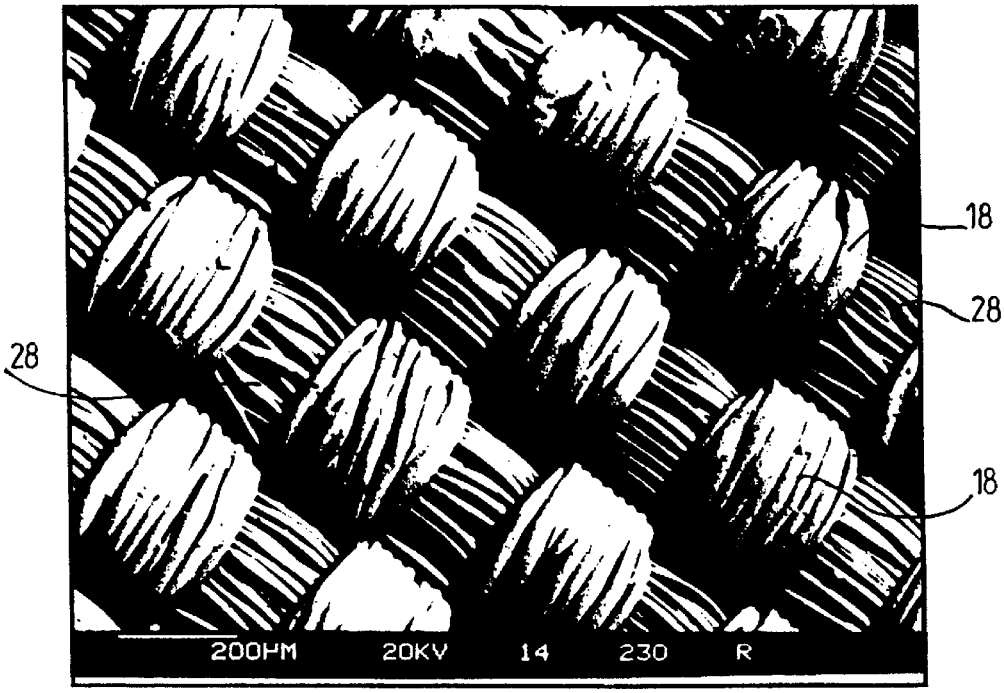
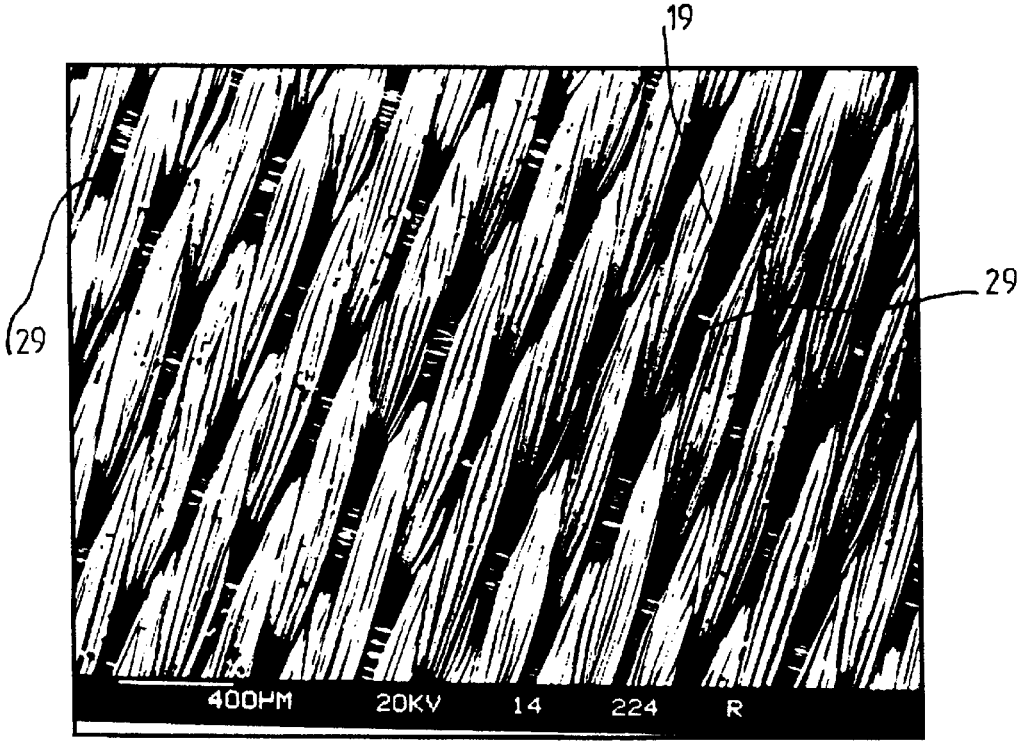
Fig. 9

LAPPING AND POLISHING DEVICE

The invention, according to the first of its features, concerns a polishing or lapping device which has a surface which is selectively placed in rotation about an axis of revolution and on which pieces to be polished are intended to be applied, with interposition of an abrasive suspension and with a certain pressure, where said surface has a number of recessed parts that form reservoirs for the abrasive suspension, which are independent of one another, and where said recessed parts are delimited by partitions whose upper walls, in cooperation with the abrasive suspension, form the active regions for lapping or polishing.

Devices of this type can have the specific form of a disk or a cylinder.

EP-0 370 843 describes a polishing plate on whose plane surface appear flush soft and hard parts. These soft and hard parts are distributed in a manner suitable for adjusting the length of the intervals between the hard parts.

This allows one to greatly increase the efficiency of the polishing plate, that is, the quantity of material removed per unit time.

However, the manufacture of this plate is still relatively complex.

A device of the type defined in the preceding is described in U.S. Pat. No. 5,297,364.

According to the teaching of this earlier patent, the partitions delimiting the reservoirs for the abrasive suspension are of different height depending on whether they are open or closed; the lateral walls of these partitions form a right angle with the upper walls of these partitions, and the reservoirs and the partitions are distributed in an irregular manner both radially and tangentially.

However, the effectiveness of this device remains limited.

The invention aims to reduce these disadvantages by proposing a lapping or polishing device of simplified manufacture whose efficiency is increased.

For this purpose, the device of the invention, which, in other respects according to its generic definition in the preamble above, is essentially characterized in that the partitions have an approximately constant height over the entire surface of the device before use of the device, in that the recessed parts are delimited by lateral walls forming an angle less than 90° with the upper walls, and in that the recessed parts and the partitions are distributed regularly over each circle centered on the axis of revolution.

Preferably, the ratio between the smallest thickness of said partitions and the largest dimension of the recessed parts is between approximately 1:3 and 1:6, and is preferably equal to 1:5.

Preferably, the depth of the recessed parts or the height of the partitions is between 0.05 and 15 mm and particularly between 0.05 and 10 mm.

Moreover, the thickness of the upper walls of the partitions is advantageously between 0.5 and 15 mm.

The angle between the lateral walls and the upper wall of a partition is advantageously greater than or equal to 75°.

In order to ensure the uniform polishing or lapping of the pieces which are to be polished, the recessed parts and the partitions are preferably regularly distributed over the entire surface of the device.

For a lapping or polishing device present in the form of a disk, the surface of the upper walls of the partitions advantageously increases from the edge of the disk towards the center of the disk.

The lapping or polishing device according to the invention is preferably made up of at least one synthetic resin mixed with at least one powder, particularly one based on metal or a ceramic.

Abrasive particles, particularly those based on aluminum oxides, silicon carbides or natural or synthetic diamond, can be mixed with said resin.

In one embodiment of the device according to the invention, the partitions define geometric shapes of the polygonal or circular types.

In another embodiment the surfaces of the lapping or polishing device according to the invention corresponds to the positive or negative relief of a fabric of the taffeta or satin type.

The invention according to the second of its features concerns a process for obtaining a polishing or lapping device as defined in above, where this process is characterized in that it consists of:

pouring, in a mold of appropriate form, a mixture of at least one synthetic resin and at least one powder, in particular one based on metal or ceramics, possibly containing abrasive particles, allowing said mixture to harden and proceeding to remove it from the mold.

In one embodiment example of the process, the mold consists of the negative reproduction of a grating and of a plate obstructing it.

In another embodiment example of the process, the mold has a surface whose relief is that of a fabric of the taffeta or satin type or its negative.

The invention will be better understood and its other aims, advantages and characteristics will appear more clearly upon reading the following description given in connection with the appended drawings, in which:

FIG. 4 is a top view in detail of an embodiment variant of the device illustrated in FIGS. 1 to 3;

FIG. 5 is a view in cross section along line V—V of FIG. 4;

FIG. 6 is a top view in detail of another embodiment example of the device according to the invention;

FIG. 7 is top view in detail of yet another embodiment example of the device according to the invention;

FIG. 8 is a photograph of a fabric of the taffeta type, seen from above, on a scale of 200 $\mu$m;

FIG. 9 is a photograph of a fabric of the satin type, seen from above, on a scale of 400 $\mu$m;

FIG. 1 shows an embodiment example of the lapping or polishing device according to the invention which is in the form of a disk whose flat surface has a number of recessed parts 1 which are delimited between one another by partitions 2.

Figure 2:
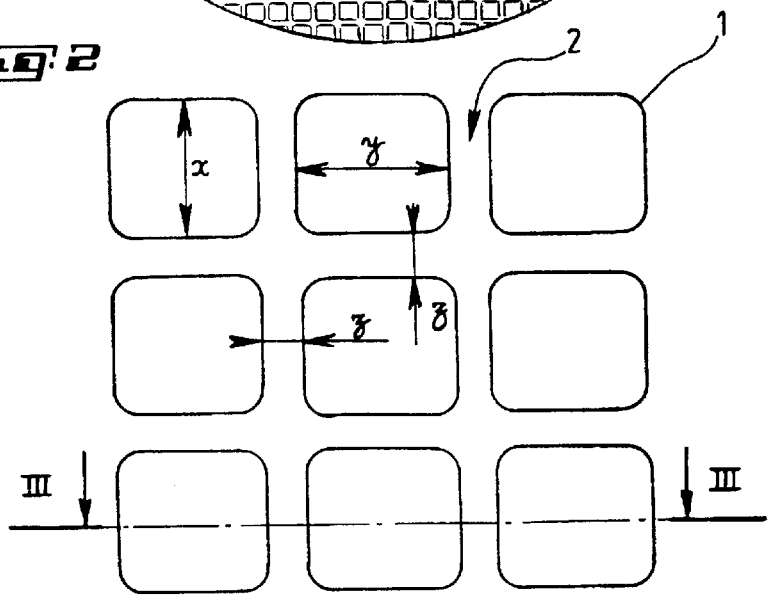
FIG. 2 is a detail of FIG. 1.

As shown more precisely in FIG. 2, recessed parts 1 are in this case approximately square, and are regularly distributed over the surface of the disk according to the invention.

The disk is intended for use with an abrasive suspension which is sprayed over the entire surface of the disk. In order to perform the lapping or polishing, the disk is rotated, and the pieces to be polished are applied on its surface with a certain pressure.

Thus, recessed parts 1 form a number of reservoirs for the abrasive suspension.

These reservoirs are independent of one another, since each reservoir is delimited by partitions 2. In the course of use of the disk according to the invention, the abrasive suspension, sprayed beforehand into each reservoir, is regularly extracted from it.

Furthermore, partitions 2 are defined by upper wall 20 and two lateral walls 21 and 22.

Upper walls 20 of partitions 2, in cooperation with the abrasive suspension sprayed on the disk, are the ones which form the active regions of the disk for the lapping or polishing.

These partitions 2 have a height h which is preferably uniform over the entire surface of the disk in order to ensure uniform lapping or polishing of the pieces to be polished.

This depth h also defines the depth of each recessed part or reservoir 1.

The studies conducted showed that this height h is advantageously between approximately 0.05 and 15 mm and preferably between 0.05 and 10 mm. In this range of values, the recessed parts effectively function as reservoirs, while allowing part of the abrasive suspension to pass over the upper walls of partitions 2 during use of the disk.

Furthermore, it is advantageous for the thickness of partitions 2 or else the dimension z of upper surface 20 of the partitions to be between 0.5 and 15 mm, in order to contribute to the effectiveness of the removal of material, during use of the disk according to the invention.

It has also been established that the ratio between thickness z of partitions 2 and side x or y of recessed parts 1 is advantageously between approximately 1:3 and 1:6, and that this ratio is in particular equal to 1:5.

Furthermore, it is preferable for the relief angle $\alpha$ between upper wall 20 of partition 2 and lateral wall 21 or 22 to be less than 90°. This is due to the fact that the device according to the invention is advantageously obtained by molding, as will be seen subsequently in the description.

Furthermore, it is preferable for this angle not to be less than 75°, so that the active surface of the disk, consisting of all of the upper walls of partitions 2, is not modified appreciably when the disk undergoes wear and tear after prolonged use.

Additionally, when angle $\alpha$ is greater than 75°, it has been possible to observe that the evacuation of the abrasive suspension and of the abraded material is facilitated.

The invention is, of course, not limited to the form of recessed parts 1 and of partitions 2 illustrated in the figures.

Recessed parts 1 be of any geometric form, particularly polygonal, rectangular or hexagonal, for example, or else circular, such as a round or oval shape.

The surface of the lapping or polishing device according to the invention can also correspond to the negative or positive relief of a fabric, particularly of the satin or taffeta type.

The negative relief of these fabrics defines recessed parts forming reservoirs for the abrasive solution and raised parts forming partitions between the reservoirs. The size of the reservoirs depends on the size of the threads of the fabric as well as on the texture of this fabric.

Reference is made to FIGS. 8 and 9 which illustrate respectively a fabric of the taffeta type and a fabric of the satin type. Raised elements 18 and 19 respectively will form the reservoirs of the device according to the invention, and recessed elements 28 and 29 respectively will form the partitions of this device.

This is also the case for the positive relief of these same fabrics.

The ranges of values given in the preceding for the thickness of the wall, the depth of the reservoirs, the relief angle of the partitions as well as the ratio between the thickness of the wall and the dimensions of the recessed parts can be applied to any shapes of the recessed parts and partitions, based on the average depth of the reservoirs, the smallest thickness of the partitions and the largest dimension of the recessed parts.

This will now be illustrated with regard to FIGS. 6 and 7 which illustrate variants of execution of the device according to the invention, again in the form of a disk.

In reference to FIG. 6, recessed parts 16 have the form of an equilateral triangle, and they are delimited by partitions 26.

In this example, the smallest dimension of reservoirs 16, corresponding to the height of the triangle, is indicated by x, and the largest dimension of the reservoirs, corresponding to a side of the triangle, is indicated by y. Thus, the ratio z/y is advantageously between approximately 1:3 and 1:6.

In reference to FIG. 7, recessed parts 17 have the form of an oval or ellipse, and they are delimited by partitions 27.

In this example, the smallest dimension of reservoirs 17 is indicated by x, corresponding to the minor axis of the ellipse, and the largest dimension of the reservoirs is indicated by y, corresponding to the major axis of the ellipse. Additionally, the smallest thickness of partitions 27 is indicated by z. In this case again, the ratio z/y is advantageously between approximately 1:3 and 1:6.

The invention is also not limited to a lapping or polishing device in the form of a disk with a flat surface.

Thus, the surface of the disk can concave or convex. Furthermore, the device can also be cylindrical, where the active polishing or lapping surface is the external or internal surface of the cylinder.

Generally, the device according to the invention is a revolving surface whose axis of revolution is the axis of rotation of the device on the lapping or polishing machine on which it is used.

For the polishing or lapping to be uniform, it is advantageous for the recessed parts and the partitions to be distributed regularly over the entire curve defining a plane perpendicular to the axis of revolution of the device and all of whose points are equidistant from the axis of revolution.

Thus, for a lapping or polishing device according to the invention in the form of a cylinder, the recessed parts and the partitions are distributed uniformly over the entire surface of the device which is intended to receive pieces which are to be polished.

For a device present in the form of a disk, the recessed parts and the partitions are distributed regularly over any circle of any radius.

Figure 10:
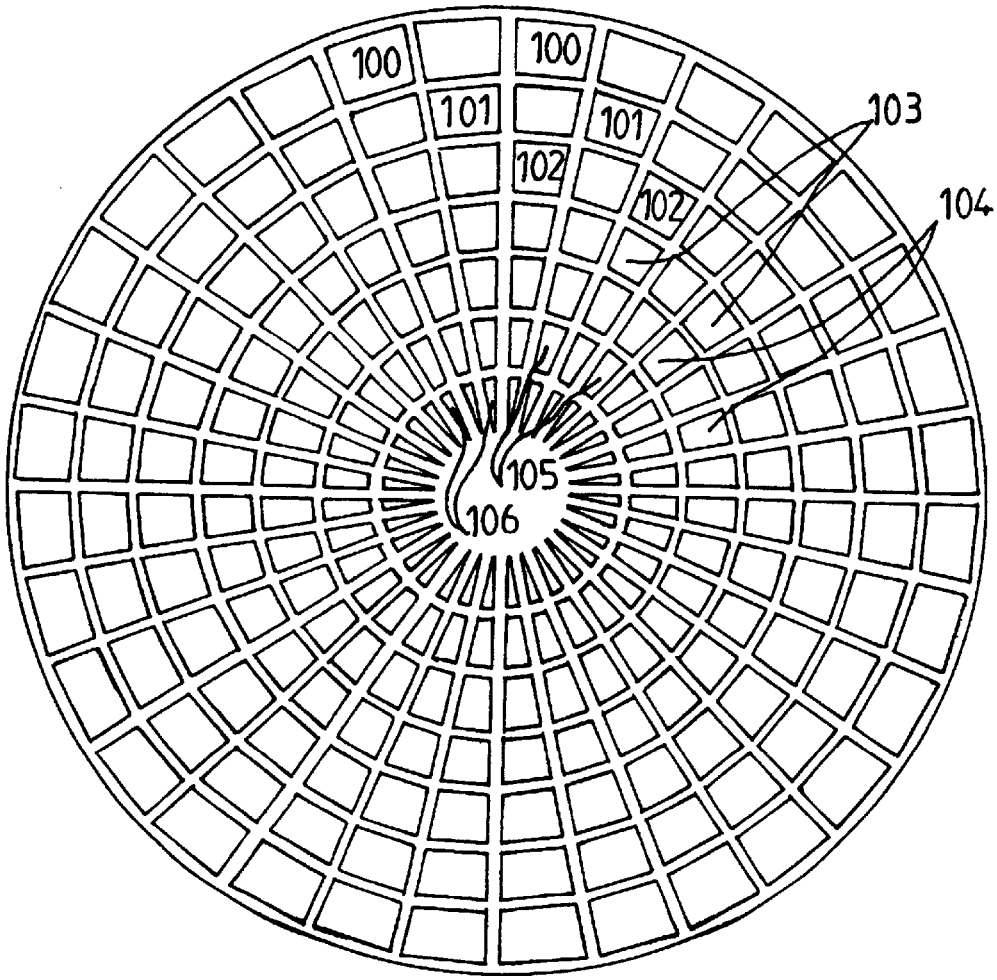
FIG. 10 is a top view of another embodiment example of a device according to the invention, which is in the form of a disk.

This is illustrated by FIG. 10 which shows a lapping or polishing disk according to the invention whose recessed parts are in the form of a trapezoid.

These recessed parts are distributed according to seven concentric circles. All the recessed parts 100, 101, 102, 104, 105, 106 respectively defining a circle with a given radius, have the same form and the same dimensions. In contrast, from one circle to the next, the form and dimensions of the recessed parts differ.

When the device according to the invention is in the form of a disk, its wear and tear in the case of prolonged use is more extensive at the center of the disk than at the edge.

Thus, in order to reduce the difference in wear and tear between the center and edge of the disk according to the invention, it is desirable for the surface of the upper walls of the partitions or else the thickness of the partitions to be greater at the center of the disk than towards the edge. In this case, the surface of the reservoirs can be smaller towards the center of the disk than at the edge. It can thus be provided that the surface of the upper walls of the partitions uniformly increases from the edge of the disk towards the center according to the diameter of the disk.

In this regard, reference is made to FIGS. 4 and 5.

Figure 1:
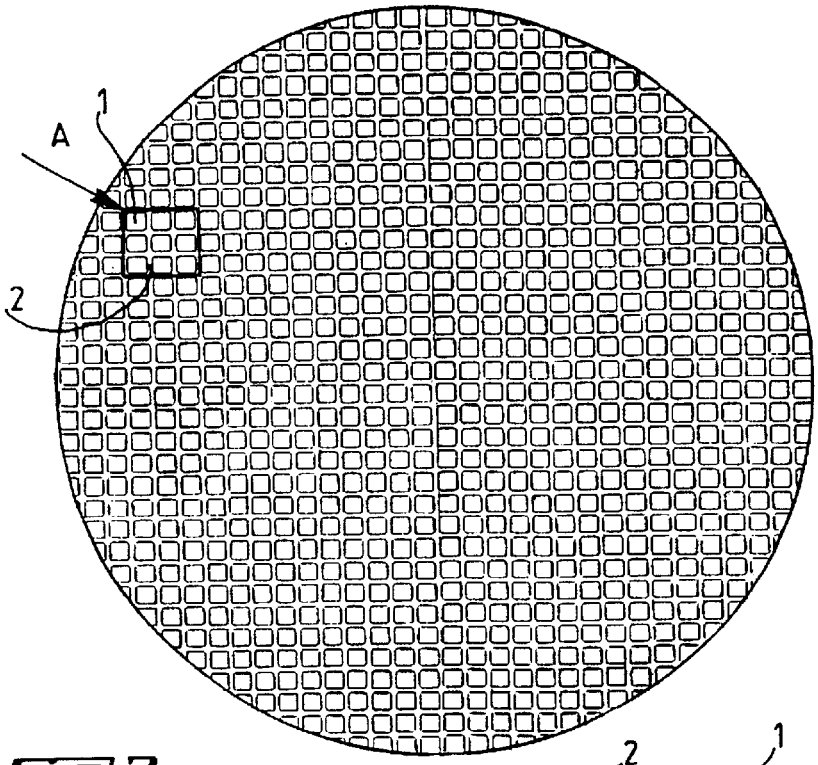
FIG. 1 is a top view of an embodiment example of a lapping or polishing device according to the invention, which is in the form of a disk.
Figure 3:
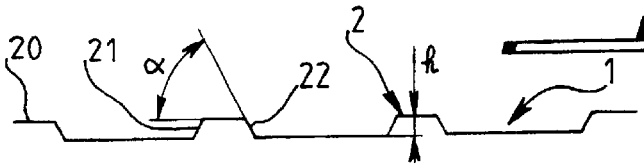
FIG. 3 is a view in cross section along line III—III of FIG. 2.

FIG. 4 shows, seen from the top, a detail of an embodiment variant of the device illustrated in FIGS. 1 to 3.

This detail shows a particular distribution of the recessed parts and of the partitions according to a diameter of the device according to the invention, which is in the form of a disk. The right part of FIG. 4 corresponds to a region of the disk closer to the center of the disk, whereas the left part of this figure corresponds to a region closer to the edge of the disk.

Thus, with this distribution, the dimensions of the square recessed parts decrease from the edge of the disk towards the center, whereas the thickness of the partitions between the recessed parts increases from the edge of the disk towards the center.

Thickness zb of partition 24*b* between recessed parts 14*c* and 14*b* is therefore greater than thickness za of partition 24*a* between recessed parts 14*b* and 14*a*.

In the example illustrated, side xc of recessed part 14*c* is smaller than side xb of recessed part 14*b*, which in turn is smaller than side xa of recessed part 14*a*.

However, in order to compensate for the wear and tear of the disk between the edge and the center, it is sufficient for the thickness of the partitions to be larger towards the center of the disk than towards the edge, with the dimensions of the recessed parts being approximately identical.

The device according to the invention is advantageously obtained by molding a material made of a pure metal or a composite metal, that is, at least one synthetic resin mixed with at least one solid powder, particularly a metallic powder or a ceramic-based powder.

In this case, it is possible to use in particular a resin of the polyurethane or polyester type and metallic powders of the iron, copper, lead, tin, zinc, aluminum or stainless steel type.

The mold has the form of the desired counterpart, in order obtain the desired recessed parts and partitions. Thus, in practice, the mold will have domes where each dome represents a reservoir.

The mold can consist of the negative reproduction of a grating whose empty spaces represent the partitions and with which a plate obstructing it is associated.

The use of this mold is advantageous when the partitions of the device according to the invention, constituting its active part, must be produced out of a relatively expensive material. In effect, with this mold, the bottom of the reservoirs can then be produced separately from another material.

A mold used for producing a device according to the invention can also be present in the form of a stamped plate on which the reservoirs are reproduced.

This mold can again have a surface whose relief is that of a fabric of the taffeta or satin type (see FIGS. 8 and 9) or the negative relief of such a fabric.

Tests have shown that lapping or polishing devices according to the invention have significant advantages with respect to the devices known in the state of the art.

As indicated above, a device according to the invention is used in association with an abrasive suspension which is sprayed on its surface.

This spraying allows each reservoir on the surface of the device to be supplied with abrasive suspension.

During the actual lapping or polishing, that is, when the pieces to be polished or lapped are applied on the device according to the invention, the pieces distribute the abrasive suspension over the surface of the device.

Tests have shown that for devices according to the invention, the distribution of the abrasive suspension is practically immediate.

Cleaning of the devices according to the invention is periodically performed manually, since the abraded material becomes deposited to a great extent in the reservoirs.

Furthermore, comparative tests have been perform between:

a disk marketed by the applicant company under the name "New Lam," of the blue disk type for a blank and according to the teaching of European Patent No. 0 370 848. This disk therefore has a flat surface with hard parts, which are in this case produced with a synthetic resin and iron particles whose grain size is less than 50 $\mu$m, and soft parts produced from the same synthetic resin mixed with copper particles whose grain size is less than 20 $\mu$m, and a disk according to the invention obtained by molding a material consisting of the same synthetic resin as the New Lam disk described above, mixed with iron particles whose grain size is less than 40 $\mu$m. The surface of this disk according to the invention has a number of recessed parts in the form of squares whose sides x, y are equal to 3 mm, where said squares are separated by partitions whose thickness is 0.6 mm. Moreover, the height h of the partitions or the depth of the recessed parts is 0.43 mm, while the angle $\alpha$ between the upper surface and a lateral wall of each partition is equal to 80°. Furthermore, the distribution of the recessed parts and of the partitions is uniform over the entire surface of the disk.

The test conditions are the following:

A metallography machine is used, whose plate has a diameter of 200 mm, corresponding to the diameter of the disk according to the invention and of the New Lam blue disk described above. The plate of the machine turns at a speed of 150 rpm.

The tests are performed with three samples whose dimensions are 10×20 mm, of the 316 LS type, resin-coated and having a final diameter of 40 mm.

These three samples are placed in a sample holder, and during the lapping, the applied pressure is 9.5 kg.

The lapping is done in six 10-min cycles.

The removal of material is measured at the end of each cycle by measuring the difference in weight. The measurements are given in mg.

Two types of tests were performed:

in test A, each plate was cleaned after each 10-minute cycle, in test B, the plates are not cleaned between the cycles.

The results are given together in Table 1 below:

TABLE 1

| | Removal of Material | | | |
|---|---|---|---|---|
| | Test A Cleaning Of Plate Between Each Cycle | | Test B No Cleaning Of Plate Between Cycles | |
| Cycle Duration (10 minutes) | Standard NL Blue Disc | Disc According To The Invention | Standard NL Blue Disc | Disc According To The Invention |
| 1st Cycle | 33 | 95 | 34 | 93 |
| 2nd Cycle | 32 | 96 | 35 | 90 |
| 3rd Cycle | 31 | 97 | 37 | 89 |
| 4th Cycle | 31 | 97 | 30 | 91 |
| 5th Cycle | 31 | 96 | 24 | 93 |
| 6th Cycle | 31 | 96 | 20 | 92 |
| TOTAL | 189 | 577 | 180 | 548 |

The results obtained show that the efficiency of the disk according to the invention, that is the quantity of material removed per unit time, is three times that of the New Lam blue disk used for the tests.

Thus, these tests show that the disk according to the invention makes it possible to increase polishing or lapping efficiency.

The following reasons can be put forward in order to explain why the device according to the invention makes it possible to obtain a greater removal of material with respect to a disk of the type described in EP-0 370 843, without limiting the scope of the invention:

In the case of a disk described in EP-0 370 843, the entire surface of the disk constitutes a surface of contact with the piece to be polished. In contrast, in a disk according to the invention, only the upper surfaces of the partitions can be in contact with the piece to be polished.

Inasmuch as the piece to be polished is applied with the same pressure regardless of the disk, the pressure on the active surfaces will be greater for a disk according to the invention than for a disk of the type described in EP-0 370 843. This greater pressure on the active surfaces contributes towards increasing the removal of material.

In the case of the lapping or polishing device according to the invention, it is also possible to consider the presence of recessed parts and partitions to create an acceleration of the abrasive particles present in the abrasive suspension, between the recessed parts forming reservoirs and the upper part of the partitions constituting an active surface for the lapping.

In this regard, inasmuch as the surface of the piece to be polished or to be lapped is greater than the surface of the reservoirs, application of the piece to be polished on the device can be considered to create suction allowing the abrasive suspension present in the reservoirs to be drawn in.

These tests also show that the device according to the invention can be used without the necessity of cleaning it between each lapping or polishing cycle, which constitutes a great savings in terms of time during lapping or polishing operations.

In contrast, in the case of the New Lam blue disk, the absence of cleaning leads to a deterioration of the abrasive film. This deterioration is indicated in base tint in the table. It appears by the fourth lapping or polishing cycle.

In effect, starting from the fourth cycle, the abrasive film is no longer uniform, and it is necessary to stop the machine in order to clean the plate, lapping or polishing no longer being possible.

Additional tests were perform to measure the regularity of the surface of the samples after six lapping cycles.

The surface roughness of the samples obtained after polishing the two disks was measured with a surface roughness-meter with a surface profiler of the Mahr Perthen type.

The measurements taken show that the total roughness, or Rt, is 1.2 $\mu$m with the New Lam blue disk and 0.9 $\mu$m with the disk according to the invention.

Furthermore, the average roughness, or Ra, is 0.11 micron with the New Lam blue disk and 0.08 micron with the disk according to the invention.

Thus, the disk according to the invention makes it possible to obtain a surface condition which is improved by approximately 30%.

The surfaces of the samples lapped with each of the disks described above were also checked with a Leitz optical microscope.

It was again possible to observe that the samples lapped with the disk according to the invention had a surface with improved regularity with respect to the sample lapped with the previously described New Lam blue disk.

The preceding results relating to the roughness show another advantage of the lapping or polishing devices according to the invention.

In effect, it is generally desirable for the lapped pieces to have an average roughness Ra of less than 0.10 micron.

With a definite number of lapping cycles and a given abrasive suspension, the disk according to the invention described above makes it possible to obtain pieces whose average roughness Ra is effectively less than 0.10 micron which is not the case with the pieces lapped with the previously described New Lam blue disk.

Thus, in order to obtain lapped pieces whose average roughness Ra is less than 0.10 micron, with the New Lam blue disk, it is will be necessary to use an abrasive suspension whose abrasive particles have a smaller grain size than that used in the preceding tests. Consequently, the lapping time will necessarily be longer.

Thus, the lapping or polishing device according to the invention makes it possible to reduce the lapping or polishing time with respect to the conventional disks, while obtaining a similar roughness.

Furthermore, the disk according to the invention allows a greater handling ability when the lapping is done manually.

Another comparative test was done in order to measure the wear and tear of the two disks described above.

These measurements were taken after two hours of lapping.

For each plate, two measurements were taken at three different points distributed according to the radius of each disk:

a point near the center of the disk, a point located midway along the radius and a point near the periphery of the disk.

The measurements were made using a micrometer, and each result is the average of two measurements.

These measurements were confirmed for the disk according to the invention by a measurement performed with the microscope of the difference in level between the bottom of a recessed part or reservoir and the upper surface of a partition or lapping surface.

All the results obtained are given together in the table below; the measurements are given in $\mu$m.

TABLE 2

| Measurement After Two Hours of Lapping | Wear and tear | | |
|---|---|---|---|
| | Center | Midway Along Radius | Edge |
| Blue NL Disc | 80 | 55 | 45 |
| Disc According To The Invention | 70 | 50 | 40 |

The results reported in this table show that the disk according to the invention makes it possible to improve the resistance to wear and tear by approximately 10%, with respect to a disk of the type described in EP-0 370 843.

It was indicated in the preceding that the device according to the invention could be obtained by molding a material consisting of pure metal or composite metal, that is, a mixture of at least one synthetic resin and at least one solid powder, particularly a metallic powder.

The material used to produce the lapping or polishing device according to the invention may be one material; it is also possible to provide for producing the device according to the invention from two or more different materials, in the case in which one wishes to obtain regions of different hardness on the surface of the device.

As an example, a first material constituting the device according to the invention may be a mixture of polyester resin and a metallic powder, while a second constitutive material may be a mixture of polyurethane resin and another metallic powder.

Furthermore, the material constituting the device according to the invention may contain abrasive grains, particularly based on aluminum oxides, silicon carbides, or else natural or synthetic diamond.

Finally, it may be noted that the device according to the invention may be present in the form of a sheet attached in a removable manner on a medium of appropriate form by any suitable means. The device according to the invention may also form the active surface for the abrasion and its medium in a single piece.

The invention is, of course, not limited to the different embodiments just described, and it includes all their technical equivalents as well as their combinations if they are included in the scope of the claims.

Finally, the reference symbols inserted after the technical characteristics appearing in the claims are only to facilitate comprehension of these claims and are not capable of limiting their scope.

What is claimed is:

1. A device which has a surface which is selectively placed in rotation about an axis of revolution and pressed against articles to be polished with interposition of an abrasive suspension, said surface having recesses forming reservoirs for the abrasive suspension, the reservoirs being independent of one another and defined by partitions, each partition having two lateral walls and an upper wall extending between the two lateral walls, the upper walls forming active regions of the surface for lapping and polishing, wherein the partitions have an approximately uniform height over all of said surface of the device before use of the device, the recesses are defined by lateral walls forming an interior angle ($\alpha$) less than 90° with the upper walls, and the recesses and partitions are distributed regularly in a radial direction from the axis of revolution.

2. The device according to claim 1, wherein the partitions have a thickness comprising the distance between the lateral walls and the recesses have first and second dimensions comprising the distance between two parallel partitions, and a ratio between the smallest thickness of the partitions and the largest dimension of the recesses is between approximately 1:3 and 1:6.

3. The device according to claim 1 wherein the height of the partitions is between 0.05 and 15 mm.

4. The device according to claim 1, wherein the thickness of the partitions is between 0.5 and 15 mm.

5. The device according to claim 1, wherein the angle ($\alpha$) is at least 75° and less than 90°.

6. The device according to claim 1, wherein the recesses and the partitions are distributed uniformly over said surface.

7. The device according to claim 1, in the form of a disk, wherein a surface area of the upper walls increases towards a center of the disk.

8. The device according to claim 1, comprising at least one synthetic resin mixed with at least one metal or ceramic powder.

9. The device according to claim 8, wherein abrasive particles chosen from the group consisting of aluminum oxide, silicon carbide, and natural and synthetic diamond are mixed with said resin.

10. The device according to claim 1, wherein the reservoirs are polygonal or circular.

11. The device according to claim 1, wherein said surface corresponds to a positive or negative relief of a fabric of one of taffeta and satin.

12. A process for producing a device according to claim 1 comprising:

pouring into a mold a mixture of at least one synthetic resin and at least one metal or ceramic powder, optionally containing abrasive particles, hardening said mixture and removing said mixture, after hardening, from the mold.

13. The process according to claim 12, wherein said mold includes an inverse reproduction of a grating and of a plate obstructing the grating.

14. The process according to claim 13, wherein said mold has a surface with a relief simulating a direct or inverse pattern of a fabric of one of satin and taffeta.

* * * * *